United States Patent [19]

Trentman

[11] 4,422,630

[45] Dec. 27, 1983

[54] BLADE HOLDER AND METHOD OF USING THE SAME

[75] Inventor: John L. Trentman, Tipp City, Ohio

[73] Assignee: Harris Corporation, Melbourne, Fla.

[21] Appl. No.: 378,380

[22] Filed: May 14, 1982

[51] Int. Cl.[3] ..... B42B 2/00

[52] U.S. Cl. ..... 270/53; 493/370; 493/402; 83/876; 83/883

[58] Field of Search ..... 270/53, 37; 282/11.5 A; 493/228–230, 241, 402, 365–368, 370, 371, 471, 475; 83/863, 864, 872, 873, 876, 878, 883, 887, 665, 695, 696

[56] References Cited

U.S. PATENT DOCUMENTS

| | | | |
|---|---|---|---|
| 2,065,487 | 12/1936 | Broadmeyer | 270/53 X |
| 2,935,002 | 5/1960 | Robinson | 282/11.5 A |
| 3,381,560 | 5/1968 | Mages | 493/370 X |
| 3,880,056 | 4/1975 | Dohnalik | 493/241 X |
| 4,114,869 | 9/1978 | Gladow | 270/53 X |

*Primary Examiner*—A. J. Heinz

*Attorney, Agent, or Firm*—Biebel, French & Nauman

[57] ABSTRACT

A crimp blade holder for attachment to a rotatable shaft for removably mounting a plurality of crimp blades includes a body in which first and second cylinder portions are joined together at an end face of each, such that the portions are disposed along a common axis. A hole extends axially through the body, the shaft being insertable through the hole. A plurality of slots are arranged about the periphery of the first portion in a spaced relationship for removably inserting one of the crimp blades into each of the slots. Additional slots are arranged about the periphery of the second portion, in a second, distinct spaced relationship, also for the removable insertion of one of the crimp blades into each of the slots. The crimp blades are secured within either of the groups of slots, and the body is secured to the shaft at a selected one of a plurality of positions along the shaft. A method of using the described blade holder is also disclosed.

4 Claims, 9 Drawing Figures

BLADE HOLDER AND METHOD OF USING THE SAME

BACKGROUND OF THE INVENTION

The present invention relates to a device for holding a plurality of baldes such as might be used for crimping a moving multilayer paper web at a plurality of locations along its length. Such a holder is particularly useful in machines for collating several paper webs, such as might be done in the manufacture of business forms.

Multilayer, preprinted business forms are commonly used, for instance, where it is desired to make multiple copies of a document at the same time. In manufacturing such forms, a single layer web is printed for each layer of the form, and the individual webs are then supplied to a collator for proper arrangement into layers. Normally, after collating, a perforation is provided across the webs at a plurality of predetermined locations, so that individual forms may be separated from the web for use. The individual forms typically are not separated until immediately before or after use, and the forms are packaged for shipment and/or storage by folding the web in accordion-like fashion along the perforations.

In order to keep the various layers of the form together until such time as it is desired to separate them, it is common to provide a plurality of crimps along each edge of the multilayer web during collating. The crimping is normally performed by a series of crimp blades, each of which has a plurality of fingers for cooperating with grooves provided in an anvil surface. The fingers puncture and pass through the web into the grooves of the anvil surface, thereby providing a plurality of slots through the layers of the web. The crimp blades are designed, however, such that the small portions of the paper layers originally located where the slots are formed are not severed from the web, but rather pushed downwardly through the slot formed in the underlying layers. These small portions of paper thus serve to hold the various layers together.

The crimp blades are usually mounted to one or more blade holders which in turn are mounted to a rotatable shaft. The multilayer web is passed between the blade holders and the cooperating anvil surfaces, and the blade holder shaft is rotated at a speed such that the fingers of the crimp blades and the web approach each other at the same linear speed. Thus, as the web is passed by the blade holders, the blades crimp the web in a pattern predetermined by the arrangement of the blades along the holders.

In addition to the perforations provided across the multilayer web, and the crimping provided along the edges of the web, the web is further provided with a series of holes along the edges of the web. These holes may be used for advancing the web, both during manufacture of the forms, and during their use, for instance, where the individual forms are prepared by a computer printout. Typically, the holes are disposed along the edge of the web at a spacing of 0.50 inch (1.27 cm) center-to-center, and equipment used with forms has been designed to be compatible with such spacing.

Thus, the crimps to be effective must be located along the web so as to avoid the holes. Accordingly, as can be seen in FIG. 1, the crimps are typically centered 0.25 inch (0.635 cm) from the centers of adjacent holes, and are thereby separated from other crimps by an integer number of half-inches.

The perforations separating successive forms represent yet another constraint on the location of the crimps. The perforations must also be located so as not to fall on the holes, and thus, as seen in FIG. 1, are also located 0.25 inch (0.635 cm) from the centers of adjacent holes. It is not desirable, however, for the crimps to fall along a perforation. In such a case, the crimps could begin premature, partial separation of individual forms along the perforation, thereby making accidental full separation much more likely. Moreover, the crimps prevent even, neat folding along the perforations, interfering with the proper arrangement of the web for storage and/or shipping.

The separation between consecutive perforations along the web is, of course, determined by the desired length for the form. In the United States, the two most common lengths for forms are $8\frac{1}{2}$ inches (21.6 cm) and 11 inches (27.9 cm), and in Europe, the most common lengths are $8\frac{1}{2}$ inches (21.6 cm) and 12 inches (30.5 cm). In the case of 11-inch and 12-inch forms, as well as any other form of a length of an integer number of inches, it can be seen that consecutive perforations are separated by an even number of half-inch intervals. The crimp blades can therefore be arranged to provide crimps in intervals of an even number of half-inches. By separating the initial crimp from the initial perforation by an odd number of half-inch intervals, the perforations and crimps will not coincide.

This approach is not usable in the case of $8\frac{1}{2}$ inch forms. Since the perforations are separated by an odd number of half-inch intervals, a separation of an even number of intervals between crimps would result in at least some perforations coinciding with a crimp. Thus, it can be seen that a particular arrangement of crimp blades that is suitable for use with 11-inch forms is not usable with $8\frac{1}{2}$ inch forms, and vice versa.

Typically, the problem of crimp spacing for different sizes of forms is solved by providing two different crimp blade holders, one size for each of the different forms. When the collator is to be readied for changing from one size form to another, the blade holders mounted to the rotatable shaft must be disassembled and removed from the shaft, and a new set of blade holders providing a different spacing must be installed. This represents a relatively time-consuming process, and requires the operator of the collator to keep two sets of crimp blade holders on hand.

What is needed, therefore, is a single set of crimp blade holders that are capable of use with either $8\frac{1}{2}$ or 11 inch forms. Such holders should be capable of arranging crimp blades such that in either case, crimps do not coincide with perforations along the multilayer web. Further, preparing the crimp blade holders for use with one size of form following use with another size form should be relatively quick and simple to perform.

SUMMARY OF THE INVENTION

The present invention provides a crimp blade holder for attachment to a rotatable shaft for removably mounting a plurality of crimp blades. The holder is capable of mounting the blades in two different arrangements, for crimping the edges of a moving web in either one of two distinct patterns.

The holder includes a body in which first and second cylinder portions are joined together at an end face of each, such that the portions are disposed along a common axis. A hole extends axially through the body, and the shaft is insertable through the hole. A plurality of slots are arranged about the periphery of the first portion in a spaced relationship for removably inserting one of the crimp blades into each of the slots. Additional slots are arranged about the periphery of the second portion, in a second spaced relationship, also for the removable insertion of one of the crimp blades into each of the slots. The crimp blades are secured within either of the groups of slots, and the body is secured to the shaft at a selected one of a plurality of positions along the shaft.

The crimp blade holder may be provided such that the outer diameter of the first cylindrical portion is greater than the outer diameter of the second cylindrical portion. Further, the first portion may include five slots, while the second portion includes four.

The slots may be arranged about the first cylindrical portion such that upon insertion of the crimp blades into the five slots of the first portion, the crimping portion of each of the blades is disposed along the circumference of a circle defined by the crimping portion of the blades approximately 2 inches (5.08 cm) from the crimping portion of the next adjacent of the blades. The slots are arranged about the second cylindrical portion such that upon insertion of the crimp blades into the four slots of the second portion, the crimping portions of the blades are disposed along the circumference of the circle defined by the crimping portion of the blades with relative spacings of approximately 2, 2, 2 and 2½ inches (5.08, 5.08 , 5.08 and 6.35 cm) between the crimping portions of adjacent ones of of the blades.

The body may be secured to the shaft by including in the holder a set screw, the body having a threaded bore extending from the periphery of the body to the axial hole for receiving the screw. A key is provided, cooperating with the shaft and the axial hole, the bore opening into the hole adjacent the key.

The present invention also provides a method for changing the relative spacing of crimping of a moving multilayer web. The crimping is performed by a plurality of crimp blades removably mounted within a plurality of slots disposed in a space relationship along the periphery of a first portion of a crimp blade holder having two portions disposed adjacent each other. The holder is secured to a rotatable shaft passing through the holder. The method includes the steps of inserting a second plurality of crimp blades into a plurality of slots disposed along the periphery of the second of the portions of the holder, the slots being disposed in a spaced relationship distinct from the spaced relationship of the slots disposed along the first portion. The second plurality of crimp blades are secured within the slots, and the holder is loosened on the shaft. The holder is moved along the shaft to a selected position whereby the second plurality of crimp blades is located for crimping the web in a desired location therealong, and the holder is secured to the shaft in the selected position.

The method may include the further step of removing the first plurality of crimp blades from the slots disposed along the periphery of the first portion of the holder.

Accordingly, it is an object of the present invention to provide a crimp blade holder for removably mounting a plurality of crimp blades having a body including first and second cylindrical portions and a plurality of slots arranged about the periphery of each portion in differing spaced relationships for removably inserting one of the crimp blades into each of the slots; to provide such a holder that will produce crimps along a web that do not coincide with perforations also located along the web; to provide such a holder that is usable with any of several common sizes of forms; to provide a method whereby the relative spacing of the crimping of a moving web may be changed without requiring changing of holder assemblies; and to provide such a method that may be performed relatively quickly and easily.

Other objects and advantages will be apparent from the following description, the accompanying drawings, and the appended claims.

DETAILED DESCRIPTION OF THE PREFERRED EMBODIMENT

Figures 2, 3, 7:
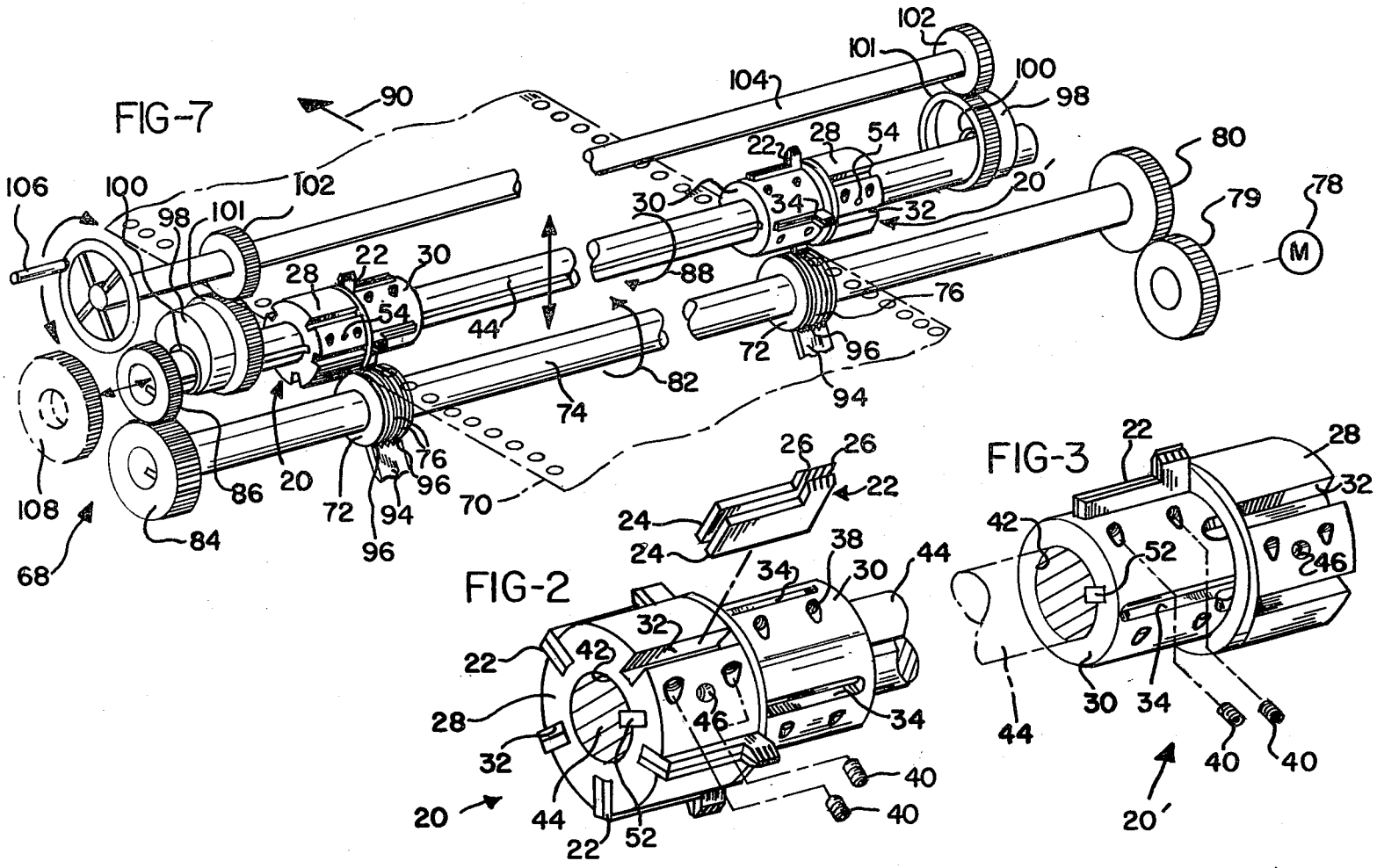
FIG. 2 is a perspective view of a crimp blade holder of the present invention for crimping one edge of a web.
FIG. 3 is a perspective view of a crimp blade holder for crimping the opposite edge of the web.
FIG. 7 is a perspective, partially schematic view of an apparatus for crimping the edges of a paper web, including the crimp blade holders of the present invention.

Referring generally to the drawings, and in particular to FIG. 2, a crimp blade holder 20 is shown for removably mounting a plurality of crimp blades 22. Each of crimp blades 22 includes two halves 24 and is provided with a plurality of fingers 26 for crimping a web.

Figure 4:
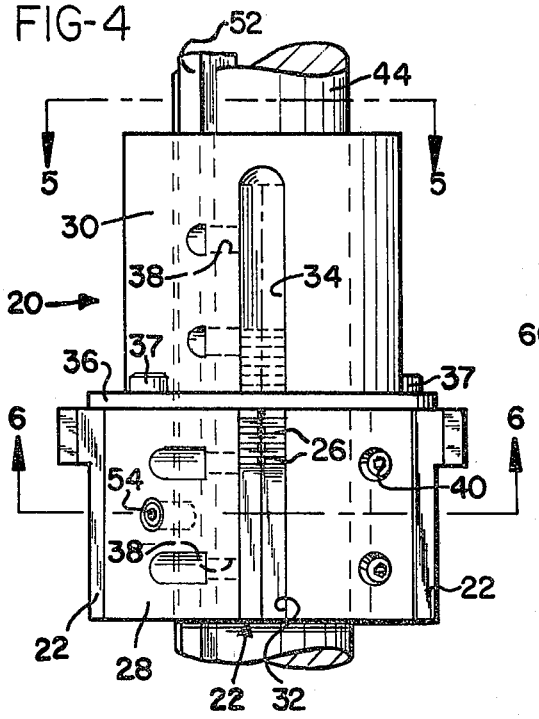
FIG. 4 is a top plan view of a crimp blade holder having crimp blades mounted within a first set of slots.

Blade holder 20 includes a first cylindrical section 28 and a second cylindrical section 30. Referring also to FIG. 4, cylindrical sections 28 and 30 are joined together along an end face of each, and are disposed such that the axis of each cylindrical section lies along a common line. Cylindrical section 28 is provided with a plurality of slots 32 located along the periphery of section 28, and cylindrical section 30 includes a plurality of slots 34 defined about its periphery. A crimp blade 22 may be inserted into each of slots 32 and 34. An annular ring 36 is attached by bolts 37 to the end of section 28 adjacent section 30, thereby closing off the ends of slots 32. Ring 36 provides for accurate positioning of blades 22 within either of slots 32 or 34, with the blades 22 being inserted into slots 32 or 34 so as to abut ring 36.

Each of slots 32 and 34 includes a pair threaded bores 38 opening into the slot 32 or 34 through one of its side walls. Each bore 38 is oriented to intersect the side wall perpendicular thereto, and extends through the surrounding cylindrical portion 28 or 30, opening along the periphery thereof. Each bore 38 is adapted to receive a set screw 40, which may be advanced or retracted along bore 38 by an appropriate tool, such as an Allen wrench (not shown). When a crimp blade 22 is inserted into a slot 32 or 34, the set screws 40 disposed within the corresponding bores 38 are advanced and tightened against the blade 22, thereby clamping blade 22 firmly in place.

Figure 6:
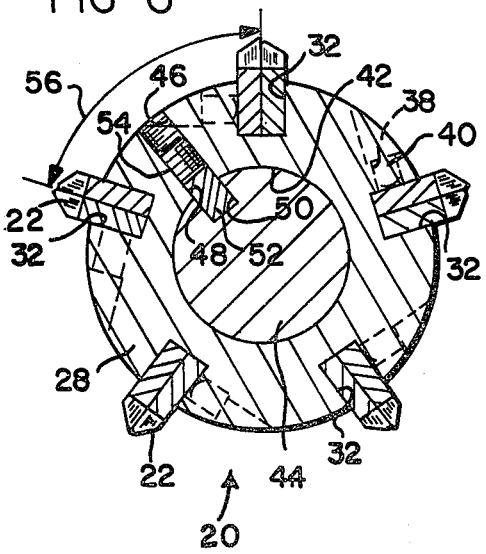
FIG. 6 is a view taken generally along line 6—6 of FIG. 4.

Blade holder 20 further includes an axial hole 42 formed through both portions 28 and 30. Hole 42 is sized accordingly such that a shaft 44 may be inserted therethrough for mounting holder 20. Referring now to FIG. 6, showing cylindrical portion 28 in section, blade holder 20 includes a threaded bore 46 extending radially through portion 28. A groove 48 is provided extending the full length of hole 42 through holder 20, and threaded bore 46 opens into hole 42 through groove 48. A similar groove 50 is provided along shaft 44, extending substantially the full length of shaft 44. Both grooves 48 and 50 cooperate when blade holder 20 is mounted to shaft 44 to form a keyway for proper positioning of holder 20 on shaft 44. A key 52 is inserted into groove 50 of shaft 44, and also fits into groove 48 of holder 20. A set screw 54, engageable with threaded bore 46, is inserted into bore 46 and advanced toward and tightened against key 52, thereby securing blade holder 20 in a desired position along shaft 44.

It can be seen from FIG. 6 that the slots 32 disposed along the periphery of section 28 for mounting blades 22 are disposed therealong such that the relative spacing between adjacent slots 32 is the same. In the preferred embodiment, slots 32 are arranged such that the distance between any adjacent pair of blades 22 along a circle defined by the centers of the pitch line of blades 22 when mounted within slots 32, as indicated generally by arrow 56, is 2 inches (5.08 cm). Thus, blades 22 inserted into slots 32 will produce a series of crimps along a web having a center-to-center spacing of 2 inches (5.08 cm) between any adjacent crimps.

Figure 5:
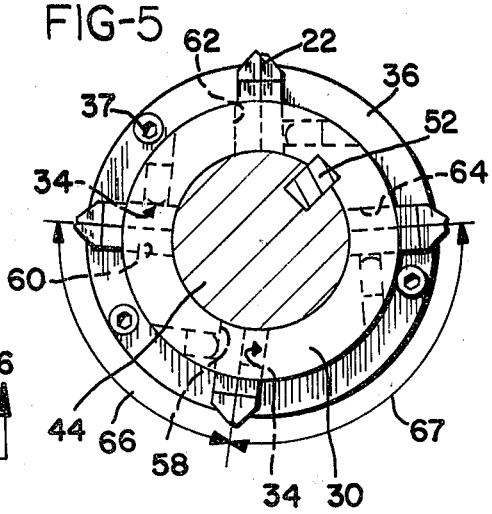
FIG. 5 is a view taken generally along line 5—5 of FIG. 4, but with the blades mounted within the second set of slots.

Referring now to FIG. 5, it can be seen that slots 34 disposed along cylindrical portion 30 are spaced in a different manner from slots 32 along cylindrical portion 28. Slots 34, which include slots 58, 60, 62, and 64, are disposed in the preferred embodiment about cylindrical portion 30 with an uneven spacing between adjacent slots. The distance between blades 22 mounted within slots 58 and 60 along the circumference of a circle defined by the center of the pitch line of blades 22 when mounted within slots 34, indicated by arrow 66, is 2 inches (5.08 cm). Similarly, the pitch line spacing between blade tips when inserted in slots 60 and 62, and slots 62 and 64, is also 2 inches (5.08 cm). The pitch line spacing between blade tips when inserted in slots 64 and 58, however, indicated by arrow 67, is 2½ inches (6.35 cm). Accordingly, when blades mounted within slots 34 are used for crimping a web, a repetitive pattern of crimps with center-to-center spacing of 2, 2, 2 and 2½ inches (5.08, 5.08, 5,08, and 6.35 cm) will be produced.

The apparatus 68 with which blade holder 20 is used for crimping a moving web is shown in schematic fashion in FIG. 7. A pair of blade holders 20 and 20' are mounted to shaft 44 for providing crimps along both edges of a moving web 70. It can be seen, however, by comparing FIGS. 2 and 3, that the blade holders 20 include both a left-hand holder 20 and a right-hand holder 20', distinguished by the direction from which threaded bores 38 approach slots 32 and 34, and by the location of slot 58 (see FIG. 5). By providing these variations in blade holder 20, it can be seen that an operator can manipulate set screws 40 in either of blade holders 20 or 20' for insertion or removal of blades 22 from the same side of shaft 44.

Referring back to FIG. 7, a pair of anvil surface members 72 are provided mounted to a rotatable shaft 74. Each anvil surface 72 is provided with a plurality of annular grooves 76 adapted such that fingers 26 of blades 22 will fit into grooves 76.

Shaft 74 is driven at one end by motor 78 through gears 79 and 80, in a direction indicated by arrow 82. A gear 84 is mounted to the opposite end of shaft 74, and engages a gear 86 mounted to one end of shaft 44. Thus, motor 78 and gears 79 and 80 also drive shaft 44, rotating it in a direction indicated by arrow 88.

Web 70 is passed between shafts 44 and 74 in the direction indicated by arrow 90. During the crimping operation, shafts 44 and 74 are spaced such that fingers 26 of blades 22 mounted to blade holders 20 and 20' engage the annular grooves 76 of anvil surface members 72. Web 70 is passed along anvil surface members 72, and fingers 26 of blades 22 perforate web 70, providing a plurality of crimps 92 along the edges of web 70. Gears 79 and 80 and gears 84 and 86 are appropriately selected so that the surfaces of anvil surface members 72 and the fingers 26 of blades 22 are rotated with a linear speed equal to the speed of the moving web 70.

Each anvil surface member 72 is provided with a cleaner 94 disposed adjacent member 72 on a side opposite web 70. Cleaner 94 has a plurality of fingers 96 extending one each into each of the annular grooves 76 of member 72. Fingers 96 act during rotation of members 72 to clear any paper dust or other debris from grooves 76.

As shown in FIG. 7, the crimping apparatus 68 is set up with blades 22 mounted to the slots 34 of cylindrical portions 30 of blade holders 20 and 20', so as to produce the crimp pattern provided by the spacings of blades 22 along the periphery of portions 30.

The operation of the apparatus 68 for changing the crimp pattern applied to web 70 is described as follows. Advance of the web 70, as well as the rotation of shafts 44 and 74, is halted. Shaft 44 is then raised away from web 70, thereby raising blades 22 from anvil surface members 72 and disengaging gears 84 and 86.

In order to raise and lower shaft 44, a pair of eccentric bearing housings 98 are provided near each end of shaft 44. Bearings 100 are mounted into each housing 98 so that shaft 44 is freely rotatable within the housings 98, which in turn are journalled to a support frame (not shown). A gear 101 is mounted concentrically to an end of each housing 98. A pair of gears 102, mounted to a shaft 104, engage gears 101. Shaft 104 may be rotated by a handle 106 or the like, so that rotation of handle 106 rotates gears 101 and thus housings 98, raising and lowering shaft 44. Blades 22 are thereby moved into and out of operating position.

Once shaft 44 has been raised from web 70, blades 22 may be inserted into slots 32 of cylindrical portions 28 of blade holders 20 and 20'. Set screws 54 may then be loosened, allowing holders 20 and 20' to be slidably moved along shaft 44. Holders 20 and 20' are repositioned so that blades 22 within slots 32 of portion 28 are properly aligned for engaging grooves 76 of anvil surface members 72.

Because of the difference in diameter between portions 28 and 30 of blade holders 20 and 20', the rotational speed of shaft 44 must be adjusted, depending upon which slots of holder 20 or 20' are in use. To avoid tearing of the web 70 during the crimping process, the holders 20 and 20' must be rotated so that the tips of blades 22 approach the moving web 70 with the same velocity as web 70. To make this adjustment during the changing of the crimp pattern, gear 86 mounted to the end of shaft 44 is removed. A different sized gear 108 is installed at the end of shaft 44, resulting in a new gear ratio between gears 84 and 108, and thereby adjusting the rotational speed of shaft 44 to compensate for the difference in diameter between portions 28 and 30.

Following installation of gear 108, handle 106 is rotated to lower shaft 44 such that blades 22 will properly engage web 70. Web 70 is then advanced, shafts 44 and 74 are rotated, and web 70 is crimped in the pattern defined by the positioning of slots 32 along cylindrical portions 28 of blade holders 20 and 20'.

It can be seen that, depending upon the particular dimensions of blade holders 20 and 20', the apparatus 68, and the crimp blades 22, it may or may not be necessary to remove the blades 22 from the slots 32 or 34 of the portions 28 or 30 of the blade holders 20 and 20' when the slots of the other portions are in use. With the spacings of slots 32 and 34 provided in the preferred embodiment, blades 22 may be left mounted within slots 34 of portions 30 when slots 32 of portions 28 are in use. When slots 34 are in use, however, blades 22 must be removed from slots 32.

Figure 1:
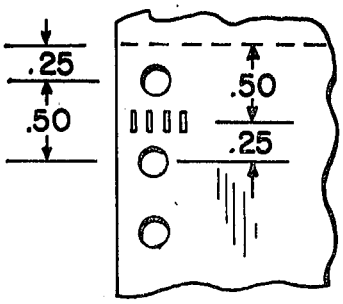
FIG. 1 is a plan view of a portion of a multilayer paper web, showing relative spacings therealong of holes, a perforation, and a crimp, in which the dimensions presented are in inches.
Figure 8:
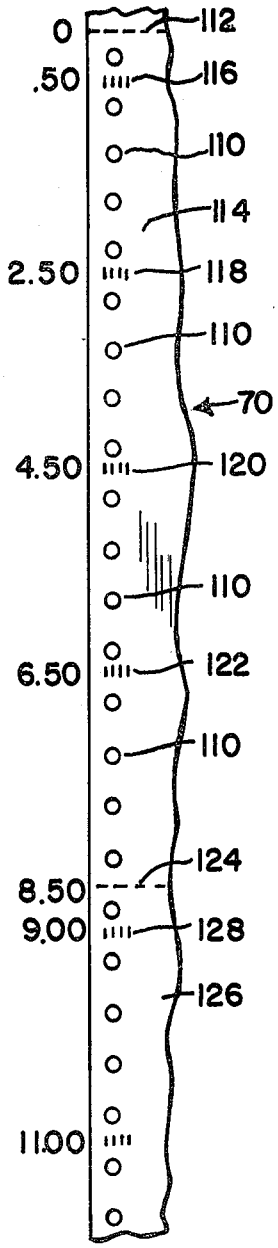
FIG. 8 is a plan view of a portion of a web showing the locations of crimps produced by the crimp blade holder along an 8½ inch form, in which the dimensions shown are in inches.
Figure 9:
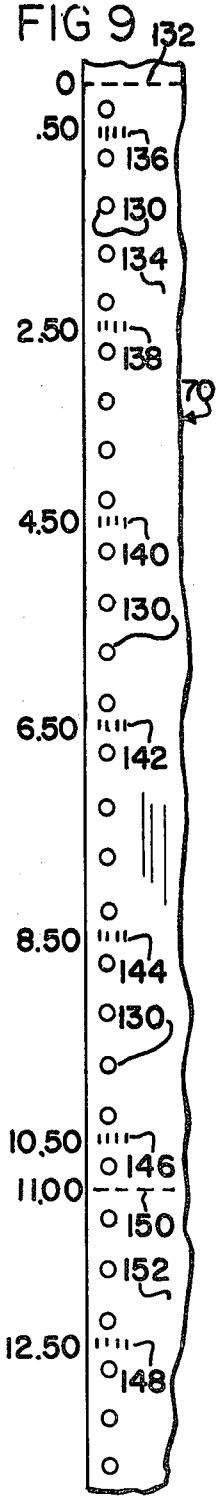
FIG. 9 is a plan view of a portion of a web showing the locations of crimps produced by the crimp blade holder along an 11-inch form, in which the dimensions shown are in inches.

The crimp patterns produced by blade holder 20 as provided in the preferred embodiment are seen in FIGS. 8 and 9. In FIG. 8, the pattern produced along the edge of a web 70 by blades 22 mounted within the slots 34 along cylindrical portion 30 is shown, appropriately spaced for use with 8½ inch (21.6 cm) forms. Holes 110 are provided along the edge of web 70, with a spacing of 0.50 inch (1.27 cm) center-to-center between adjacent holes. A perforation 112 extends across web 70, centered 0.25 inch (0.635 cm) between adjacent holes 110, and defines the upper edge of one form 114. The first crimp 116 of the pattern is placed 0.50 inch (1.27 cm) below perforation 112, also centered between a pair of holes 110. As indicated by the dimensional figures shown along the edge of web 70, the next crimps 118, 120 and 122 are located 2 inches (5.08 cm) apart, at distances from perforation 112 of 2.50, 4.50, and 6.50 inches (6.35, 11.4 and 16.5 cm), respectively. A perforation 124 forming the division between the form 114 and the next succeeding form 126 appears 8.50 inches (21.6 cm) below perforation 112. The next succeeding crimp 128, with the interval produced by the uneven spacing occurring between slots 64 and 58 of holder 20, is located 2.5 inches (6.35 cm) below the immediately preceding crimp 122, or 9.00 inches (22.9 cm) below perforation 112. It will be noticed, however, that this crimp 128 is located 0.50 inch (1.27 cm) below perforation 124. Moreover, since four crimps have already been placed on web 70, corresponding to one for each of the four slots 34 on cylindrical portion 30, the pattern has been begun again. Thus, it will be seen that the crimp pattern will be repeated in similar fashion, with none of the crimps falling on any of the perforations.

The crimp pattern produced by blades 22 mounted within the slots 32 of cylindrical portion 28 of blade holder 20, suitable for use with 11 inch (27.9 cm) forms, may be seen in FIG. 9. As in FIG. 8, the edge of a web 70 is shown, having a plurality of holes 130 located with spacings of 0.50 inch (1.27 cm) center-to-center between successive holes 130. A perforation 132 defines the top edge of an 11-inch (27.9 cm) form 134, and the first crimp 136 is produced 0.50 inch (1.27 cm) below perforation 132. The next succeeding crimps 138, 140, 142 and 144 are located 2.50, 4.50, 6.50, and 8.50 inches (6.35, 11.4, 16.5 and 21.6 cm) below perforation 132, respectively. Crimp 146, located 10.50 inches (26.7 cm) below perforation 132, corresponds to a beginning again of the pattern produced by cylindrical portion 28. Crimp 148, located 12.50 inches (31.75 cm) below perforation 132 is also located 1.50 inches (3.81 cm) beneath perforation 148, which defines the beginning of the next succeeding form 152. Although crimp 148 is 1.50 inches (3.81 cm) below perforation 150, rather than 0.50 inch (1.27 cm) as in the case of crimp 136 and perforation 132, it can be seen that since the interval between succeeding crimps is consistently 2 inches (5.08 cm), none of the crimps will occur along a perforation.

It will also be recognized from FIG. 9 that the spacing of the crimps produced by cylindrical portion 28 of blade holder 20 are suitable for use with any form having a length of an integer number of inches, such as 12-inch (30.5 cm) forms.

While the method and form of apparatus herein described constitute preferred embodiments of this invention, it is to be understood that the invention is not limited to this precise method and form of apparatus, and that changes may be made in either without departing from the scope of the invention, which is defined in the appended claims.

What is claimed is:

1. A crimp blade holder for attachment to a shaft and for removably mounting a plurality of crimp blades, comprising:

a body having first and second cylindrical portions, each of said portions having a periphery defining an outer diameter, said portions being joined together at an end face of each of said portions and disposed along a common axis;

said body having a hole extending axially therethrough, said shaft being insertable through said hole;

said first portion having a plurality of slots arrangement about the periphery thereof in a first spaced relationship for removably inserting one of said crimp blades into each of said slots;

said second portion having a plurality of slots arranged about the periphery thereof in a second spaced relationship for removably inserting one of said crimp blades into each of said slots;

means for securing said crimp blades within each of said slots; and means for securing said body to said shaft at a selected one of a plurality of positions therealong;

the outer diameter of said first cylindrical portion being greater than the outer diameter of said second cylindrical portion.

2. A crimp blade holder as defined in claim 1 wherein said first cylindrical portion includes five of said slots and in said second cylindrical portion includes four of said slots.

3. A crimp blade holder as defined in claim 2 wherein said slots are arranged about said first cylindrical portion such that upon insertion of said crimp blades into said five slots of said first portion, the crimping portion of each of said blades is disposed along the circumference of a circle defined by said crimping portion of said blades with relative spacings of approximately 2 inches between said crimping portions of each of adjacent ones of said blades.

4. A crimp blade holder as defined in claims 2 or 3 wherein said slots are arranged about said second cylindrical portion such that upon insertion of said crimp blades into said four slots of said second portion, the crimping portions of said blades are disposed along the circumference of a circle defined by said crimping portion of said blades with relative spacings of approximately 2, 2, 2, and $2\frac{1}{2}$ inches between said crimping portions of adjacent ones of said blades.

* * * * *